US006949288B2

(12) United States Patent
Hodge et al.

(10) Patent No.: US 6,949,288 B2
(45) Date of Patent: Sep. 27, 2005

(54) MULTICOMPONENT FIBER WITH POLYARYLENE SULFIDE COMPONENT

(75) Inventors: Michael A. Hodge, Easley, SC (US); Ramesh Srinivasan, Simpsonville, SC (US)

(73) Assignees: Fiber Innovation Technology, Inc., Johnson City, TN (US); Ticona LLC, Summit, NJ (US)

( * ) Notice: Subject to any disclaimer, the term of this patent is extended or adjusted under 35 U.S.C. 154(b) by 0 days.

(21) Appl. No.: 10/728,071

(22) Filed: Dec. 4, 2003

(65) Prior Publication Data

US 2005/0123750 A1 Jun. 9, 2005

(51) Int. Cl.[7] ..... D01F 8/00
(52) U.S. Cl. ..... 428/370; 428/373; 428/374
(58) Field of Search ..... 428/373, 374, 428/370

(56) References Cited

U.S. PATENT DOCUMENTS

| | | | |
|---|---|---|---|
| 3,326,865 | A | 6/1967 | Smith |
| 3,948,865 | A | 4/1976 | Brady et al. |
| 4,502,364 | A | 3/1985 | Zucker et al. |
| 4,563,509 | A | 1/1986 | Liang |
| 4,689,365 | A | 8/1987 | Chacko et al. |
| 4,800,113 | A | 1/1989 | O'Connor |
| 4,925,729 | A | 5/1990 | O'Connor |
| 5,057,368 | A | 10/1991 | Largman et al. |
| 5,069,970 | A | 12/1991 | Largman et al. |
| 5,108,820 | A | 4/1992 | Kaneko et al. |
| 5,244,467 | A | 9/1993 | Umezawa et al. |
| 5,277,976 | A | 1/1994 | Hogle et al. |
| 5,336,552 | A | 8/1994 | Strack et al. |
| 5,382,400 | A | 1/1995 | Pike et al. |
| 5,424,125 | A | 6/1995 | Ballard et al. |
| 5,456,973 | A | 10/1995 | Ballard et al. |
| 5,496,917 | A | 3/1996 | Fleischer et al. |
| 5,670,569 | A | 9/1997 | Scheckenbach et al. |
| 5,702,658 | A | 12/1997 | Pellegrin et al. |
| 5,851,668 | A | 12/1998 | Sandor et al. |
| 5,852,139 | A | 12/1998 | Scheckenbach |
| 5,891,988 | A | 4/1999 | Scheckenbach et al. |
| 5,907,029 | A | 5/1999 | Disch et al. |

(Continued)

FOREIGN PATENT DOCUMENTS

| | | | |
|---|---|---|---|
| DE | 199 63 242 | C1 | 7/2001 |
| EP | 0 890 444 | A2 | 1/1999 |
| JP | 59204920 | A | 11/1984 |
| JP | 63092724 | A | 4/1988 |
| JP | 02074613 | A | 3/1990 |
| JP | 2099614 | A | 4/1990 |
| JP | 3040813 | A | 2/1991 |
| JP | 3104924 | A | 5/1991 |

(Continued)

*Primary Examiner*—N. Edwards
(74) *Attorney, Agent, or Firm*—Alston & Bird LLP

(57) ABSTRACT

Multicomponent fibers having an outer exposed surafec include a polyarylene sulfide polymer component and at least one additional component formed of a different polymer. The polyarylene sulfide polymer component forms the entire exposed surface of the fiber and imparts good thermal and chemical resistance to the fiber.

25 Claims, 1 Drawing Sheet

U.S. PATENT DOCUMENTS

| | | | |
|---|---|---|---|
| 6,013,761 | A | 1/2000 | Zierer et al. |
| 6,020,442 | A | 2/2000 | Fleischer et al. |
| 6,025,440 | A | 2/2000 | Scheckenbach et al. |
| 6,080,482 | A | 6/2000 | Martin et al. |
| 6,262,224 | B1 | 7/2001 | Zierer et al. |
| 6,369,172 | B1 | 4/2002 | Zierer et al. |
| 6,409,785 | B1 | 6/2002 | Smithies et al. |
| 6,583,072 | B1 | 6/2003 | Kawakami et al. |
| 2003/0157322 | A1 | 8/2003 | Boyd et al. |

FOREIGN PATENT DOCUMENTS

| | | | |
|---|---|---|---|
| JP | 4327213 | A | 11/1992 |
| JP | 4327214 | A | 11/1992 |
| JP | 4343712 | A | 11/1992 |
| JP | 5230715 | A | 9/1993 |
| JP | 6123013 | A | 5/1994 |
| JP | 9296324 | A | 11/1997 |
| WO | WO 01/10761 | A1 | 2/2001 |

MULTICOMPONENT FIBER WITH POLYARYLENE SULFIDE COMPONENT

FIELD OF THE INVENTION

The present invention relates to fibers having a polyarylene sulfide component and products including the same.

BACKGROUND OF THE INVENTION

Filtration processes are used to separate compounds of one phase from a fluid stream of another phase by passing the fluid stream through filtration media, which traps the entrained or suspended matter. The fluid stream may be either a liquid stream containing a solid particulate or a gas stream containing a liquid or solid aerosol.

For example, filters are used in collecting dust emitted from incinerators, coal fired boilers, metal melting furnaces and the like. Such filters are referred to generally as "bag filters." Because exhaust gas temperatures can be high, bag filters used to collect hot dust emitted from these and similar devices are required to be heat resistant. Bag filters can also be used in chemically corrosive environments. Thus, dust collection environments can also require a filter bag made of materials that exhibit chemical resistance. Examples of common filtration media include fabrics formed of aramid fibers, polyimide fibers, fluorine fibers and glass fibers.

Polyphenylene sulfide ("PPS") polymers exhibit thermal and chemical resistance. As such, PPS polymers can be useful in various applications. For example, PPS can be useful in the manufacture of molded components for automobiles, electrical and electronic devices, industrial/mechanical products, consumer products, and the like.

PPS has also been proposed for use as fibers for filtration media, flame resistant articles, and high performance composites. Despite the advantages of the polymer, however, there are difficulties associated with the production of fibers from PPS. PPS fibers typically have poor mechanical properties. Accordingly PPS fibers do not have sufficient tensile strength for many applications. In addition, PPS fibers are brittle and thus are not readily manufactured into fabrics for use in downstream applications.

Prior attempts to improve the mechanical properties of PPS fibers have met with limited success. PPS has been blended with another polymer and the blend meltspun to produce monofilaments. The blend monofilaments, however, do not necessarily overcome the problems associated with the poor tensile strength and brittleness of PPS. Further, the blend monofilaments can exhibit a small improvement of one property to the detriment of another property. A monofilament, with its relatively large diameter, would also be inherently less effective in a filtration medium than a smaller diameter fiber.

Still further, the problems of producing PPS blend fibers are compounded by the limited compatibility of PPS with other polymers. A compatibilizing agent typically is required to make the fibers in the first place. Yet this can compromise the desired fiber properties and add additional processing steps and costs to fiber production.

Another approach is to mix mineral fillers or reinforcing fibers with the PPS polymer to provide sufficient strength to products produced from the PPS material. However, such blends cannot be used for fiber extrusion because of the presence of the mineral fillers and/or reinforcing fibers.

U.S. Pat. No. 5,424,125 to Ballard et al. is directed to monofilaments made of polymer blends, namely, a blend of PPS and at least one other polymer selected from polyethylene terephthalate, high temperature polyester resins, and polyphenylene oxide (PPO). The polymers of the blend are present throughout the cross section of the fiber, so that the exterior surface of the fiber includes polymers in addition to PPS. This in turn can limit the usefulness of the resultant fibers in severe service high temperature and/or corrosive environments. Further, while the Ballard et al. patent indicates that a compatibilizer is not required, the patent describes the use of compatibilizers in the production of the fibers. In addition, the Ballard et al. patent requires a large amount of polymer other than the PPS polymer, and in particular at least 50 present by weight, and higher.

Published Japanese Application 03104924 is directed to conjugate fibers stated to have good dyeability. The fibers include a polyphenylene sulfide polymer layer and a protecting layer. The protecting layer, formed of a polymer other than PPS, is required to be present on an outer surface of the fiber to impart dyeability thereto. Otherwise the fiber would not be dyeable. The resultant fiber is subjected to an oxidizing treatment using, for example, hydrogen peroxide, to oxidize the PPS. The publication indicates that the fibers must be oxidized, otherwise the fibers will not perform as required.

Other published Japanese applications discuss the production of PPS fibers. Generally the fibers include at least one polymer in addition to PPS on the outer surface thereof so as to impart desired properties to the end product. Yet, the presence of polymers other than PPS on the fiber surface compromises the properties imparted thereto by PPS. Also, generally the fibers require the presence of additional materials incorporated into the fiber, such as an electrically conductive material, an adhesion promoting agent, such as a tie layer between sheath and core components, and the like. Yet this can increase the complexity and cost of fiber production.

JP 3040813 describes fibers with a polyamide core component in combination with a PPS sheath component. As noted above, however, PPS exhibits limited compatibility with other polymers. This lack of compatibility is further exacerbated with polyamides, which generally do not adhere well to other types of polymers.

There have been attempts to improve the adhesion and/or compatibility of polyamide with PPS using various adhesion promoting techniques. For example, JP 4343712 describes a fiber including a component formed of a blend of polyamide with PPS. JP 4327213 describes a fiber with a modified PPS sheath in which the PPS includes maleic anhydride. See also JP 2099614, describing a fiber including a polyester/PPS blend core component and a PPS sheath component. Yet such techniques can increase the cost and complexity of fiber production and further can compromise fiber properties, particularly for fibers modified to include a polymer other than PPS exposed on the surface thereof.

JP 6123013 and JP 5230715 propose composite fibers including an anisotropic, e.g., a liquid crystalline polymer, component and a PPS component. Liquid crystalline polymers, however, can be expensive and difficult to melt spin, thereby also increasing the cost and complexity of such fibers.

U.S. Pat. No. 5,702,658 to Pellegrin et al is directed to a rotary process for the production of bicomponent fibers. The rotary process, similar to that used in the production of glass fibers, is stated to be useful in the production of fibers using polymers with varying physical properties, such as different viscosities. The rotary process uses centrifugal force to attenuate the fibers, in contrast to the mechanical attenuation of conventional fiber extrusion processes. For polymers with different viscosities, the centrifugal force wraps the low viscosity polymer about the higher viscosity polymer so that the interface between the two is curved.

BRIEF SUMMARY OF THE INVENTION

The present invention provides multicomponent fibers having desirable yet contradictory properties in a single fiber product. In addition, the present invention allows the production of such fibers at reduced costs.

The fibers have an exposed outer surface formed entirely of a polyarylene sulfide polymer component. The polyarylene sulfide polymer component can include one or more polyarylene sulfide polymers. An exemplary polyarylene sulfide polymer is polyphenylene sulfide (PPS). The polyarylene sulfide polymer component can impart heat and chemical resistance to the fiber.

The fibers of the invention also include at least one other polymeric component that is in direct contact with at least a portion of the polyarylene sulfide component. The additional polymer component is formed of one or more fiber-forming isotropic semi-crystalline polyester or polyolefin polymers. Exemplary isotropic semi-crystalline polyesters include aromatic polyesters, such as polyethylene terephthlate (PET), aliphatic polyesters, such as polylactic acid, and mixtures thereof. Exemplary polyolefins include polypropylene, polyethylene, and polybutene, as well as co- and terpolymers and mixtures thereof.

The polymeric component contacting the polyarylene sulfide polymeric component does not include a polyarylene sulfide polymer. This can reduce manufacturing costs and complexity. Yet surprisingly, despite the absence of a polyarylene sulfide polymer in the component contacting the polyarylene sulfide component, the fibers of the invention exhibit sufficient integrity for downstream processing. This is surprising in view of prior efforts to improve the adhesion between PPS and other polymers, for example, through the use of additional bonding agents, such as adhesives (grafted to a polymer or admixed therewith), tie layers, polymer blends, and the like. Even for polymer components with little or no compatibility, the structure of the fibers remains intact.

The fibers of the invention are designed for use in their multicomponent form, with the respective polymeric components remaining intact during use of the fiber. Thus the polymeric components are selected from polymers that are substantially insoluble in all media in which the fibers are designed to encounter. This is in contrast to multicomponent fiber constructions in which at least one of the polymeric components is designed to be dissolved to leave at least another polymeric component in the form of smaller denier filaments.

Generally the polyarylene sulfide polymer and the additional polymer(s) are inherently electrically non-conductive. For purposes of this invention, the polymers are not treated to render them electrically conductive.

The polymer components are arranged relative to one another so that the polyarylene sulfide polymer component forms the entire exposed outer surface of the fiber. Polymers other than polyarylene sulfide polymer(s) are not present at or along the outer surface of the fiber. As a result, the thermal and chemical resistance imparted to the fiber by the polyarylene sulfide polymer(s) is not compromised. In addition, the fibers can exhibit minimal or no decrease in thermal and chemical resistance, despite the reduced total volume of polyarylene sulfide polymer. Yet, even though polymers other than polyarylene sulfide are not present on an outer surface of the fiber, such polymers can impart advantageous properties thereto.

For example, the additional polymeric component can impart good mechanical properties, such as tensile strength, to the fiber, with minimal or no loss of heat and chemical resistance. Although not wishing to be bound by any explanation of the invention, it is believed that the additional polymer component can act as a load bearing component because the additional polymer is not discontinuous throughout the cross section of the fiber, as it would be in a blend. Because the additional component is not discontinuous, the additional polymer component is capable of contributing to fiber strength.

The additional polymeric component can also improve the flexibility of the fiber, with minimal or no loss of heat and chemical resistance. As a result, the thermally and chemically resistant fibers can be manipulated to form downstream products for various applications.

The thermally and chemically resistant fibers can be produced at reduced costs. Polyarylene sulfide polymers are relatively expensive polymers, as compared to many conventional fiber-forming polymers such as PET. In the fibers of the invention, the amount of polyarylene sulfide polymer can be reduced and replaced with a less expensive polymer with minimal or no comprise of the desired fiber properties, thereby reducing the overall cost of the fibers. Costs can also be reduced because adhesion promoters, such as grafted polymers, polymer blends, tie layers, and the like, are not required.

An exemplary fiber construction of the invention is a sheath core fiber, in which the sheath is a continuous covering surrounding an inner core component. In this aspect of the invention, the sheath forms the entire outer surface of the fiber and includes the polyarylene sulfide polymer. The core component is formed of the additional polymer, which is not exposed to the fiber surface, and which directly contacts the sheath component without any intervening layers, such as a tie layer.

Another exemplary fiber of the invention is an "islands-in-the-sea" fiber construction. This fiber construction includes a "sea" component, which forms the entire exposed outer surface of the fiber, and plurality of "island" components, which are distributed within, but not on the outer surface of, the fiber. The sea is formed of the polyarylene sulfide polymer, and the islands are formed of the additional polymer.

The multicomponent fibers of the invention are produced using conventional multicomponent textile fiber processes and equipment. Generally such processes include the steps of separately extruding at least two different polymers, in this case, polyarylene sulfide and at least one additional polymer such as PET, and feeding the polymers into a polymer distribution system. The polymers follow separate paths within the distribution system and are combined in a spinneret hole. After exiting the spinneret, the fluid fiber strands are attenuated mechanically. The resultant multicomponent fibers or filaments include two or more polymeric components.

The inventors have found that, even for incompatible polymers, the fiber maintains sufficient integrity for downstream processing. Thus additional bonding agents, such as an adhesive or tie layer, are not required to adhere the components to one another. Even for polymer components with little or no compatibility, the structure of the fibers remains intact.

The present invention also includes products comprising the fibers described herein. The fibers of the invention are useful, for example, in filtration media, particularly filtration media for severe service conditions, such as high temperature and/or chemically corrosive environments. The fibers of the invention are particularly useful in the production of bag filters for collecting hot dust, such as that generated by incinerators, coal fired boilers, metal melting furnaces and the like.

BRIEF DESCRIPTION OF THE SEVERAL VIEWS OF THE DRAWINGS

Figure 1:
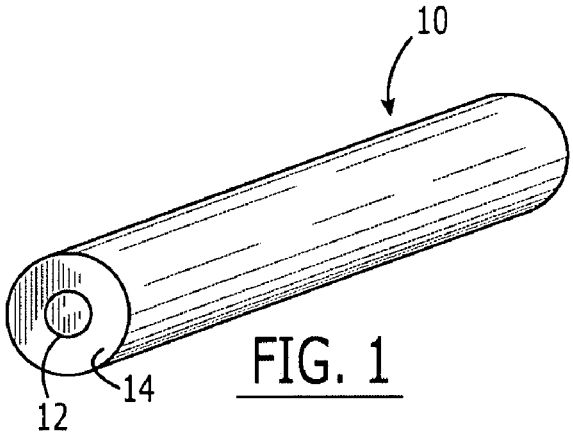
Figure 2:
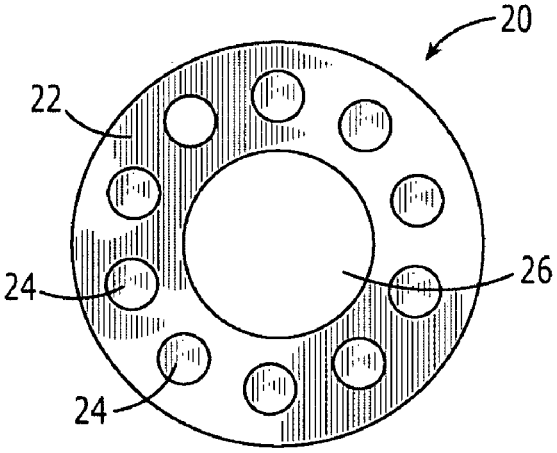
Figure 3:
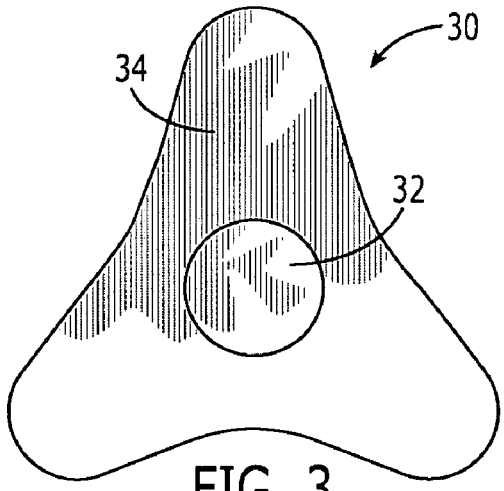

Having thus described the invention in general terms, reference will now be made to the accompanying drawings, which are not necessarily drawn to scale, and wherein:

FIG. 1 is a transverse cross sectional view of an exemplary multicomponent fiber of the invention, namely a bicomponent fiber;

FIG. 2 is a cross sectional view of another exemplary multicomponent fiber of the invention, namely an island-in-the-sea fiber; and FIG. 3 is a cross sectional view of another exemplary multicomponent fiber of the invention, namely a multilobal fiber.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As used herein, the term "multicomponent fibers" includes staple fibers and continuous filaments prepared from two or more polymers present in discrete structured domains in the fiber, as opposed to blends where the domains tend to be dispersed, random or unstructured. The two or more structured polymeric components are arranged in substantially constantly positioned distinct zones across the cross section of the multicomponent fiber and extending continuously along the length of the multicomponent fiber.

For purposes of illustration only, the present invention will generally be described in terms of a bicomponent fiber comprising two components. However, it should be understood that the scope of the present invention is meant to include fibers with two or more structured components.

FIG. 1 is a transverse cross sectional view of an exemplary fiber configuration useful in the present invention. FIG. 1 illustrates a bicomponent fiber 10 having an inner core polymer domain 12 and surrounding sheath polymer domain 14. Sheath component 14 is formed of a polyarylene sulfide polymer. Core component 12 can be formed of any of the types of polymers known in the art for fiber production, but which polymer is different from the polyarylene sulfide polymer of sheath 14. In the present invention, sheath 14 is continuous, e.g., completely surrounds core 12 and forms the entire outer surface of fiber 10. Core 12 can be concentric, as illustrated in FIG. 1. Alternatively, the core can be eccentric, as described in more detail below.

Other structured fiber configurations as known in the art can also be used, so long as the polyarylene sulfide polymer forms the entire exposed outer surface of the fiber. As an example, another suitable multicomponent fiber construction includes "islands in the sea" arrangements. FIG. 2 illustrates a cross sectional view of one such islands in the sea fiber 20. Generally islands in the sea fibers include a "sea" polymer component 22 surrounding a plurality of "island" polymer components 24. The island components can be substantially uniformly arranged within the matrix of sea component 22, such as illustrated in FIG. 2. Alternatively, the island components can be randomly distributed within the sea matrix.

Sea component 22 forms the entire outer exposed surface of the fiber and is formed of a polyarylene sulfide polymer. As with core component 12 of sheath core bicomponent fiber 10, island components 24 can be formed of any of the types of polymers known in the art for fiber production, but which are different from the sea polymer component. The islands in the sea fiber can optionally also include a core 26, which can be concentric as illustrated or eccentric as described below. When present, core 26 is formed of any suitable fiber-forming polymer.

The fibers of the invention also include multilobal fibers having three or more arms or lobes extending outwardly from a central portion thereof. FIG. 3 is a cross sectional view of an exemplary multilobal fiber 30 of the invention. Fiber 30 includes a central core 32 and arms or lobes 34 extending outwardly therefrom. The arms or lobes 34 are formed of a polyarylene sulfide polymer and central core 32 is formed of an additional polymer, which is different from the polyarylene sulfide polymer. Although illustrated in FIG. 3 as a centrally located core, the core can be eccentric.

Any of these or other multicomponent fiber constructions may be used, so long as the entire exposed outer surface of the fiber is formed of the polyarylene sulfide polymer. Reference is made to U.S. Pat. No. 5,108,820 to Kaneko et al., U.S. Pat. No. 5,336,552 to Strack et al., U.S. Pat. No. 5,382,400 to Pike et al., U.S. Pat. No. 5,277,976 to Hogle et al., and U.S. Pat. Nos. 5,057,368 and 5,069,970 to Largman et al.

The cross section of the fiber is preferably circular, since the equipment typically used in the production of synthetic fibers normally produces fibers with a substantially circular cross section. In bicomponent fibers having a circular cross section, the configuration of the first and second components can be either concentric or acentric, the latter configuration sometimes being known as a "modified side-by-side" or an "eccentric" multicomponent fiber.

Advantageously, the sheath/core fibers of the invention are concentric fibers, and as such will generally be non-self crimping or non-latently crimpable fibers. The concentric configuration is characterized by the sheath component having a substantially uniform thickness, such that the core component lies approximately in the center of the fiber, such as illustrated in FIG. 1. This is in contrast to an eccentric configuration, in which the thickness of the sheath component varies, and the core component therefore does not lie in the center of the fiber. Concentric sheath/core fibers can be defined as fibers in which the center of the core component is biased by no more than about 0 to about 20 percent, preferably no more than about 0 to about 10 percent, based on the diameter of the sheath/core bicomponent fiber, from the center of the sheath component.

Islands in the sea and multi-lobal fibers of the invention can also include a concentric core component substantially centrally positioned within the fiber structure, such as cores 26 and 32 illustrated in FIGS. 2 and 3, respectively. Alternatively, the additional polymeric components can be eccentrically located so that the thickness of the surrounding polyarylene sulfide polymer component varies across the cross section of the fiber.

Any of the additional polymeric components can have a substantially circular cross section, such as components 12, 24 and 32 illustrated in FIGS. 1, 2 and 3, respectively. Alternatively, any of the additional polymeric components of the fibers of the invention can have a non-circular cross section.

Polyarylene sulfides include linear, branched or cross linked polymers that include arylene sulfide units. Polyarylene sulfide polymers and their synthesis are known in the art and such polymers are commercially available.

Exemplary polyarylene sulfides useful in the invention include polyarylene thioethers containing repeat units of the formula $$—[(Ar^1)_n—X]_m—[(Ar^2)_i—Y]_j—(Ar^3)_k—Z]_l—[(Ar^4)_o—W]_p—$$

wherein $Ar^1$, $Ar^2$, $Ar^3$, and $Ar^4$ are the same or different and are arylene units of 6 to 18 carbon atoms; W, X, Y, and Z are the same or different and are bivalent linking groups selected from $—SO_2—$, —S—, —SO—, —CO—, —O—, —COO— or alkylene or alkylidene groups of 1 to 6 carbon atoms and wherein at least one of the linking groups is —S—; and n, m, i, j, k, l, o, and p are independently zero or 1, 2, 3, or 4, subject to the proviso that their sum total is not less than 2. The arylene units $Ar^1$, $Ar^2$, $Ar^3$, and $Ar^4$ may be selectively substituted or unsubstituted. Advantageous arylene systems are phenylene, biphenylene, naphthylene, anthracene and phenanthrene. The polyarylene sulfide typically includes at least 30 mol %, particularly at least 50 mol % and more particularly at least 70 mol % arylene sulfide (—S—) units. Preferably the polyarylene sulfide polymer includes at least 85 mol % sulfide linkages attached directly to two aromatic rings. Advantageously the polyarylene sulfide polymer is polyphenylene sulfide (PPS), defined herein as containing the phenylene sulfide structure $—(C_6H_4—S)_n—$ (wherein n is an integer of 1 or more) as a component thereof.

At least one other of the polymeric components includes a substantially insoluble fiber-forming isotropic semi-crystalline polyester or polyolefin polymer as known in the art. As used herein, the term "isotropic semi-crystalline" refers to polymers that are not liquid crystalline polymers, which are anisotropic. Exemplary isotropic semi-crystalline polyesters include without limitation aromatic polyesters, such as polyethylene terephthlate, aliphatic polyesters, such as polylactic acid, and mixtures thereof. Exemplary polyolefins include without limitation polypropylene, polyethylene (low density polyethylene, high density polyethylene, linear low density polyethylene), and polybutene, as well as co- and terpolymers and mixtures thereof.

While mixtures of the isoptropic semi-crystalline polymers may be used, the at least one other polymeric component does not include a polyarylene sulfide polymer as defined above. This can reduce manufacturing costs and complexity. Yet surprisingly, despite the absence of a polymer which is the same or chemically similar to the polyarylene sulfide polymer of the outer polymeric component, the fibers of the invention exhibit sufficient integrity for downstream processing.

In one embodiment of the invention, the fiber-forming polymer can be an aliphatic polyester polymer, such as polylactic acid (PLA). Further examples of aliphatic polyesters which may be useful in the present invention include without limitation fiber forming polymer formed from (1) a combination of an aliphatic glycol (e.g., ethylene, glycol, propylene glycol, butylene glycol, hexanediol, octanediol or decanediol) or an oligomer of ethylene glycol (e.g., diethylene glycol or triethylene glycol) with an aliphatic dicarboxylic acid (e.g., succinic acid, adipic acid, hexanedicarboxylic acid or decaneolicarboxylic acid) or (2) the self condensation of hydroxy carboxylic acids other than polylactic acid, such as polyhydroxy butyrate, polyethylene adipate, polybutylene adipate, polyhexane adipate, and copolymers containing them. Aliphatic polyesters are known in the art and are commercially available.

In another advantageous embodiment of the invention, the fiber-forming component of the fibers of the invention can include an aromatic polyester polymer. Thermoplastic aromatic polymers include (1) polyesters of alkylene glycols having 2–10 carbon atoms and aromatic diacids; (2) polyalkylene naphthalates, which are polyesters of 2,6-naphthalenedicarboxylic acid and alkylene glycols, as for example polyethylene naphthalate; and (3) polyesters derived from 1,4-cyclohexanedimethanol and terephthalic acid, as for example polycyclohexane terephthalate. Polyalkylene terephthalates, especially polyethylene terephthalate (also PET) and polybutylene terephthalate, are particularly useful in various applications. Such polyesters are well known in the art and are commercially available.

The weight ratio of the respective polymeric components of the fibers of the invention can vary. For example, the weight ratio of the polymeric components can range from about 10:90 to 90:10. One advantage of the fibers of the invention is that significantly reduced amounts of polyarylene sulfide polymer can be used with minimal or no adverse impact on the desired properties of the fibers, such as chemical and heat resistance. In this regard, the fiber-forming polymer can be present in amounts as high as 50 percent by weight and higher, e.g. up to about 60 percent by weight, and even up to about 70 percent by weight, and higher, yet the fibers can exhibit useful chemical and heat resistance properties, despite significant reduction in the total volume of the polyarylene sulfide polymer.

For example, the fibers can exhibit chemical resistance comparable to the chemical resistance of the same fiber made with 100% polyarylene sulfide polymer, even for fibers that include the fiber-forming polymer in an amount as high as 50 percent by weight, and higher. The thermal resistance exhibited by the fibers of the invention may vary as the amount of polyarylene sulfide polymer varies in a given fiber structure. The structure of the fibers thus can be tailored to include more or less polyarylene sulfide polymer as needed to provide the thermal resistance required for a given end application.

The polymers can optionally include other components not adversely affecting the desired properties thereof. Exemplary materials that could be used as additional components would include, without limitation, antimicrobials, pigments, antioxidants, stabilizers, surfactants, waxes, flow promoters, solid solvents, particulates, and other materials added to enhance processability of the first and the second components. These and other additives can be used in conventional amounts.

Methods for making multicomponent fibers are well known and need not be described here in detail. Generally the multicomponent fibers of the invention are prepared using conventional multicomponent textile fiber spinning processes and apparatus and utilizing mechanical drawing techniques as known in the art. Processing conditions for the melt extrusion and fiber-formation of polyarylene sulfide polymers are well known in the art and may be employed in this invention. Processing conditions for the melt extrusion and fiber-formation of other fiber-forming polymers useful for the additional polymer component of the fibers are also known in the art and may be employed in this invention.

To form the multicomponent fiber of the invention, at least two polymers, namely, a polyarylene sulfide polymer and at least one additional fiber-forming polymer, are melt extruded separately and fed into a polymer distribution system wherein the polymers are introduced into a spinneret plate. The polymers follow separate paths to the fiber spinneret and are combined in a spinneret hole. The spinneret is configured so that the extrudant has the desired shape.

Following extrusion through the die, the resulting thin fluid strands, or filaments, remain in the molten state before they are solidified by cooling in a surrounding fluid medium, which may be chilled air blown through the strands, or immersion on a bath of liquid such as water. Once solidified, the filaments are taken up on a godet or another take-up surface. In a continuous filament process, the strands are taken up on a godet which draws down the thin fluid streams in proportion to the speed of the take-up godet. In the jet process, the strands are collected in a jet, such as for example, an air gun, and blown onto a take-up surface such as a roller or a moving belt to form a spunbond web. In the meltblown process, air is ejected at the surface of the spinneret, which serves to simultaneously draw down and cool the thin fluid streams as they are deposited on a take-up surface in the path of cooling air, thereby forming a fiber web.

Regardless of the type of melt spinning procedure which is used, the thin fluid streams are melt drawn down in a molten state, i.e. before solidification occurs to orient the polymer molecules for good tenacity. Typical melt draw down ratios known in the art may be utilized. Where a continuous filament or staple process is employed, it may be desirable to draw the strands in the solid state with conventional drawing equipment, such as, for example, sequential godets operating at differential speeds.

Following drawing in the solid state, the continuous filaments may be crimped or texturized and cut into a desirable fiber length, thereby producing staple fiber. The length of the staple fibers generally ranges from about 25 to about 50 millimeters, although the fibers can be longer or shorter as desired.

The fibers of the invention can be staple fibers, continuous filaments, or meltblown fibers. In general, staple, multifilament, and spunbond fibers formed in accordance with the present invention can have a fineness of about 0.5 to about 100 denier. Meltblown filaments can have a fineness of about 0.001 to about 10.0 denier. The fibers can also be monofilaments, which can have a fineness ranging from about 20 to about 10,000 denier.

The fibers of the invention are useful in the production of a wide variety of products, including without limitation nonwoven structures, such as but not limited to carded webs, wet laid webs, dry laid webs, spunbonded webs, meltblown webs, and the like. The fibers of the invention can also be used to make other textile structures such as but not limited to woven and knit fabrics. Fibers other than the fibers of the invention may be present in articles produced therefrom, including any of the various synthetic and/or natural fibers known in the art. Exemplary synthetic fibers include polyolefin, polyester, polyamide, acrylic, rayon, cellulose acetate, thermoplastic multicomponent fibers (such as conventional sheath/core fibers, for example polyethylene sheath/polyester core fibers) and the like and mixtures thereof. Exemplary natural fibers include wool, cotton, wood pulp fibers and the like and mixtures thereof.

In one particularly advantageous aspect of the invention, the fibers are used as to produce filtration media. In this embodiment, the fibers of the invention can exhibit good thermal and chemical resistance. The fibers can also exhibit good flexibility and tensile strength and can be manipulated to produce products for use in corrosive and/or high temperature environments. For example, the fibers of the invention can be readily processed to produce products for use as filtration media, such as bag filters (or bag-house filters) for collecting hot dust generated by incinerators, coal fired boilers, metal melting furnaces and the like. Another use for the fibers of the invention is the production of insulation for hot oil transformers.

The present invention will be further illustrated by the following non-limiting examples.

EXAMPLE 1

100% PPS fiber

Crystallized Fortron 0309 PPS from Ticona was charged into two drying hoppers and dried for 8 hours at 280° F. The dried polymer was fed from the hoppers into two extruders, running at temperatures from 280° C. at the inlet to 305° C. at the outlet. The polymer was extruded into two gear pumps, which fed the two polymer streams into a bicomponent spin pack designed to make fibers with a sheath/core arrangement, with polymer from one extruder in the sheath of each fiber, and polymer from the other extruder in each fiber's core. The fibers were solidified in an air stream at 12.5° C. and mechanically attenuated by a pair of godets running at 992 meters per minute and wound on a bobbin at 1000 meters/minute. These fibers were further mechanically drawn on unheated rolls through a water bath at 165° F., with an overall draw ratio of 2.65:1. These fibers were judged suitable for use in baghouse filters, but the cost was prohibitive.

EXAMPLE 2

40% PPS/60% PET sheath/core fiber

Crystallized Fortron 0309 PPS from Ticona and 0.55 i.v. PET from NanYa Plastics were separately charged into two drying hoppers and dried for 8 hours at 280° F. The dried polymers were separately fed from the hoppers into two extruders, running at temperatures from 280° C. at the inlet to 295° C. at the outlet. The polymer was extruded into two gear pumps, which fed the two polymer streams into a bicomponent spin pack designed to make fibers with a sheath/core arrangement, with the PPS in the sheath of each fiber, and the PET in each fiber's core. The fibers were solidified in an air stream at 15° C. and mechanically attenuated by a pair of godets running at 842 meters per minute and wound on a bobbin at 865 meters/minute. These fibers were further mechanically drawn on unheated rolls through a water bath at 165° F., with an overall draw ratio of 2.72:1. These fibers were judged suitable for use in baghouse filters, and because of the reduced cost of the PET component as compared to the cost of PPS, the fibers were accepted for commercialization.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A multicomponent fiber having an exposed outer surface, comprising:

at least a first component comprising a polyarylene sulfide polymer, wherein said polyarylene sulfide polymer forms the entire exposed surface of the multicomponent fiber; and at least a second component free of polyarylene sulfide polymer and free of liquid crystalline polymer and contacting at least a portion of said first component, said second component comprising a substantially insoluble polymer selected from the group consisting of isotropic semi-crystalline polyesters and polyolefins.

2. The fiber of claim 1, wherein said fiber is mechanically drawn in a molten state.

3. The fiber of claim 1, wherein said polyarylene sulfide polymer comprises a polymer in which at least 85 mol % of the sulfide linkages are attached directly to two aromatic rings.

4. The fiber of claim 3, wherein said polyarylene sulfide polymer is polyphenylene sulfide (PPS).

5. The fiber of claim 1, wherein said isotropic semi-crystalline polyester is selected from the group consisting of aromatic polyesters, aliphatic polyesters, and mixtures thereof.

6. The fiber of claim 5, wherein said aromatic polyester is selected from the group consisting of polyalkylene terephthalates, polyalkylene naphthalates, polyesters derived from cyclohexanedimethanol and terephthalic acid, and mixtures thereof.

7. The fiber of claim 6, wherein said aromatic polyester is selected from the group consisting of polyethylene terephthalate, polybutylene terephthalate, polyethylene naphthalate, and polycyclohexane terephthalate.

8. The fiber of claim 7, wherein said aromatic polyester is polyethylene terephthalate.

9. The fiber of claim 5, wherein said isotropic semi-crystalline polyester is an aliphatic polyester.

10. The fiber of claim 9, wherein said aliphatic polyester is polylactic acid.

11. The fiber of claim 1, wherein said isotropic semi-crystalline polyolefin is selected from the group consisting of polypropylene, low density polyethylene, high density polyethylene, linear low density polyethylene, and polybutene, and co- and terpolymers and mixtures thereof.

12. The fiber of claim 1, wherein said fiber is a bicomponent fiber comprising a sheath component and a core component, wherein said sheath component forms the entire exposed outer surface of said fiber and comprises said polyarylene sulfide polymer, and wherein said core component is free of polyarylene sulfide polymer and free of liquid crystalline polymer and comprise a substantially insoluble polymer selected from the group consisting of isotropic semi-crystalline polyesters and polyolefins.

13. The fiber of claim 12, wherein said sheath/core fiber is a concentric sheath/core fiber.

14. The fiber of claim 1, wherein said fiber is an islands in the sea fiber comprising a sea component and a plurality of island components distributed within said sea component, wherein said sea component forms the entire exposed outer surface of said fiber and comprises said polyarylene sulfide polymer, and wherein said plurality of island components are free of polyarylene sulfide polymer and free of liquid crystalline polymer and comprise a substantially insoluble polymer selected from the group consisting of isotropic semi-crystalline polyesters and polyolefins.

15. The fiber of claim 1, wherein said fiber has a circular cross-section.

16. The fiber of claim 1, wherein said fiber has a multilobal configuration.

17. The fiber of claim 1, wherein said fiber is a staple fiber.

18. The fiber of claim 1, wherein said fiber is a continuous filament.

19. The fiber of claim 1, wherein said fiber is a meltblown fiber.

20. The fiber of claim 1, wherein the second component comprises greater than 50 percent by weight of the total weight of the fiber.

21. The fiber of claim 20, wherein the second component comprises greater than about 60 percent by weight of the total weight of the fiber.

22. The fiber of claim 21, wherein the second component comprises greater than about 70 percent by weight of the total weight of the fiber.

23. The fiber of claim 12, wherein said polyarylene sulfide polymer is polyphenylene sulfide (PPS).

24. The fiber of claim 23, wherein said core component comprises polyethylene terephthalate.

25. The fiber of claim 12, wherein said core component comprises polyethylene terephthalate.

* * * * *